US006614155B2

(12) United States Patent
Michalchuk

(10) Patent No.: US 6,614,155 B2
(45) Date of Patent: Sep. 2, 2003

(54) METHOD AND APPARATUS FOR REDUCING VIBRATIONAL ENERGY IN A TENSION FOCUS MASK

(75) Inventor: Joey John Michalchuk, Lambertville, NJ (US)

(73) Assignee: Thomson Licensing S. A., Boulogne Cedex (FR)

( * ) Notice: Subject to any disclaimer, the term of this patent is extended or adjusted under 35 U.S.C. 154(b) by 159 days.

(21) Appl. No.: 09/747,228

(22) Filed: Dec. 22, 2000

(65) Prior Publication Data

US 2002/0079805 A1 Jun. 27, 2002

(51) Int. Cl.[7] ..... H01J 29/80
(52) U.S. Cl. ..... 313/407; 313/404; 313/402
(58) Field of Search ..... 313/402, 404, 313/406, 407, 408

(56) References Cited

U.S. PATENT DOCUMENTS 4,318,025 A * 3/1982 Penird et al. ..... 313/404
4,506,188 A * 3/1985 Puhak ..... 313/269
5,525,859 A * 6/1996 Ito et al. ..... 313/402
5,644,192 A * 7/1997 Ragland, Jr. ..... 313/402
6,084,342 A * 7/2000 Ragland, Jr. ..... 313/402
6,133,682 A * 10/2000 Murai et al. ..... 313/403
6,388,369 B1 * 5/2002 Lee ..... 313/403
6,407,488 B1 * 6/2002 Ragland, Jr. ..... 313/402
6,469,430 B1 * 10/2002 Saita et al. ..... 313/404

* cited by examiner

*Primary Examiner*—Don Wong
*Assistant Examiner*—Ephrem Alemu
(74) *Attorney, Agent, or Firm*—Joseph S. Tripoli; Joseph J. Laks; Carlos M. Herrera

(57) ABSTRACT

An apparatus and method for dampening vibration of a television tube in a tension mask. The apparatus include a vibration reducing assembly that is affixed between a mask frame and a busbar assembly of a tensioned mask. The vibration reducing assembly is comprised of a tension coil spring with a pin inserted in the center of the coils. As the busbar assembly or mask is vibrated, the spring pulls and releases, allowing the internal pin to rub against the coils, scrubbing away energy. The busbar assembly and the mask are formed such that their independent resonant frequencies differ greatly from one another.

17 Claims, 4 Drawing Sheets

Tuning Fork Decay Times

| | decay time to 6 microns p-p amplitude (seconds) | decay time to 2.5 microns p-p amplitude (seconds) |
|---|---|---|
| tuned fork 100Hz | 40 | 50 |
| tuned fork 100Hz scrubbers added (paper clip type) | 17 | 30 |
| de-tuned fork 100Hz side | 12 | 17 |
| 200Hz side | 10 | 15 |

METHOD AND APPARATUS FOR REDUCING VIBRATIONAL ENERGY IN A TENSION FOCUS MASK

The invention generally relates to the reduction of vibrational energy between a frame and a busbar assembly of a tension focus mask for use in color picture tubes and, more particularly, to the method of reducing vibrational energy in tension focus masks.

BACKGROUND OF THE INVENTION

A color picture tube includes an electron gun for forming and directing three electron beams to a screen of the tube. The screen is located on the inner surface of the face plate of the tube and is made up of an array of elements of three different color-emitting phosphors. A color selection electrode, also referred to as a shadow mask, is interposed between the gun and the screen to permit each electron beam to strike only the phosphor elements associated with that beam. A shadow mask is a thin sheet of metal, such as steel, that is contoured to somewhat parallel the inner surface of the tube face plate. A shadow mask may be either formed or tensioned. A focus mask comprises two sets of conductive lines that are perpendicular to each other and separated by an insulator. When different voltages are applied to the two sets of lines to create quadrapole focusing lens in each of the focus mask openings, which forms a focus mask. One type of focus mask is a tension focus mask, wherein at least one of the sets of conductive lines is under tension. Generally, in a tension focus mask, a vertical set of conductive lines or strands is under tension and a horizontal set of conductive lines or wires overlies the strands.

Because of the shape of the focus mask, the focus mask is subject to vibration from external sources (e.g., speakers near the tube) or internal sources (e.g., the scanning electron beam). Such vibration varies the positioning of the apertures through which the electron beam propagates, resulting in visible display fluctuations. Ideally, these vibrations need to be eliminated or, at least, mitigated to produce a commercially viable television tube.

SUMMARY OF THE INVENTION

The present invention provides an apparatus and method for reducing vibrational energy in a tension focus mask (whether a focus type or not). The invention is a vibration A reducing assembly mounted between a focus mask frame and a busbar assembly. The invention controls vibrations within the cathode ray tube focus mask that cause misregistration of the electron beam to the phosphors on the screen. The need to damp these vibrations within a few seconds max is essential to the correct operation of the cathode ray tube.

More specifically, the vibration reducing assembly consists of a tension coil spring with a pin inserted into the center of the coils. As the spring pulls and releases due to focus mask vibration, the pin inserted into the coils of the spring rubs against the coils, creating friction and dissipating kinetic energy by changing the kinetic energy into thermal energy. If the focus mask movement should be in any direction that does not extend/compress the spring, but bends the spring (i.e., non-axial movement), the motion will cause the pin to roll inside the tubular spring aperture, also creating friction and dissipating motion. To further reduce vibration in the focus mask, the busbar assembly is tuned to have a far different resonant frequency than that of the focus mask resonant frequency. Therefore, the natural frequency of the focus mask works against the natural frequency of the busbar. By de-tuning the system this way, the vibrational decay time is greatly reduced.

DETAILED DESCRIPTION

Figure 1:
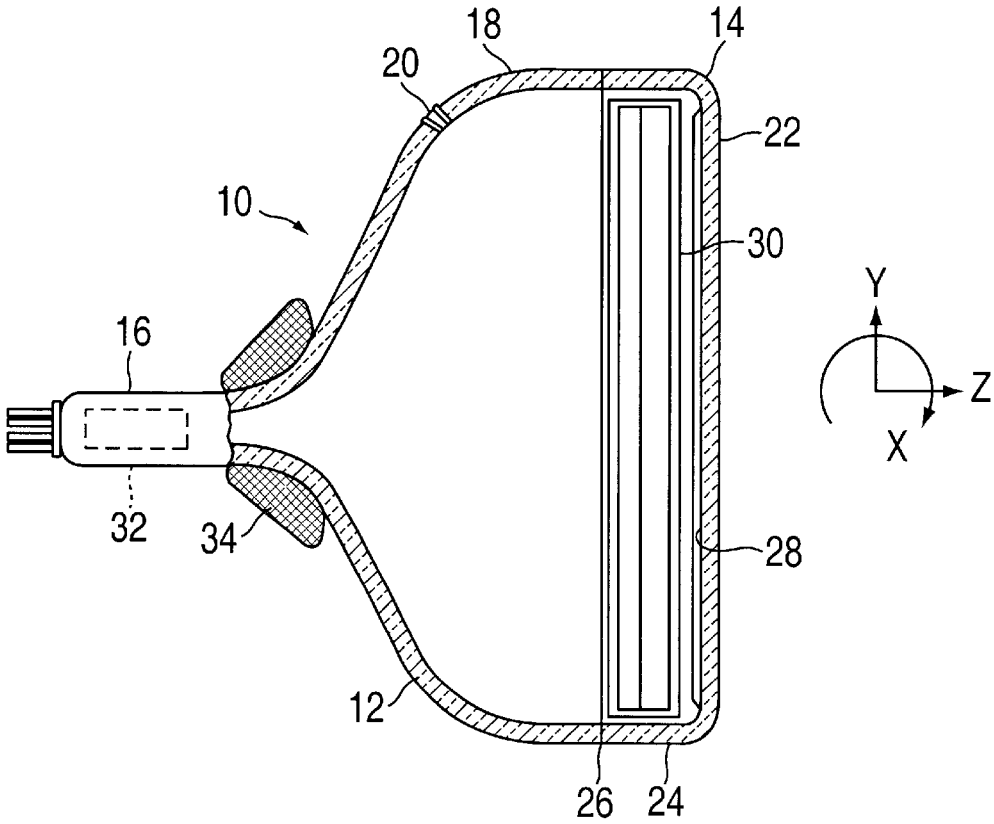
FIG. 1 is a side view, partly in axial section, of a color picture tube, including a tension focus mask assembly according go the present invention.

FIG. 1 shows a cathode ray tube 10 having a glass envelope 12 comprises a rectangular face plate panel 14 and a tubular neck 16 connected by a rectangular funnel 18. The funnel 18 has an internal conductive coating (not shown) that extends from an anode button 20 to a neck 16. The panel 14 comprises a viewing face plate 22 and a peripheral flange or sidewall 24 that is sealed to the funnel 18 by a glass frit 26. A three-color phosphor screen 28 is carried by the inner surface of the face plate 22. The screen 28 is a line screen with the phosphor lines arranged in triads, each triad including a phosphor line of each of the three colors. A cylindrical tension focus mask 30 is removably mounted in a predetermined spaced relation to the screen 28. An electron gun 32 (schematically shown by the dashed lines in FIG. 1) is centrally mounted within the neck 16 to generate three in-line electron beams, a center beam and two side beams, along convergent paths through the mask 30 to the screen 28.

The tube 10 is designed to be used with an external magnetic deflection yoke, such as the yoke 34 shown in the neighborhood of the funnel to neck junction. When activated, the yoke 34 subjects the three beams to magnetic fields that cause the beams to scan horizontally and vertically in a rectangular raster over the screen 28.

Figure 2:
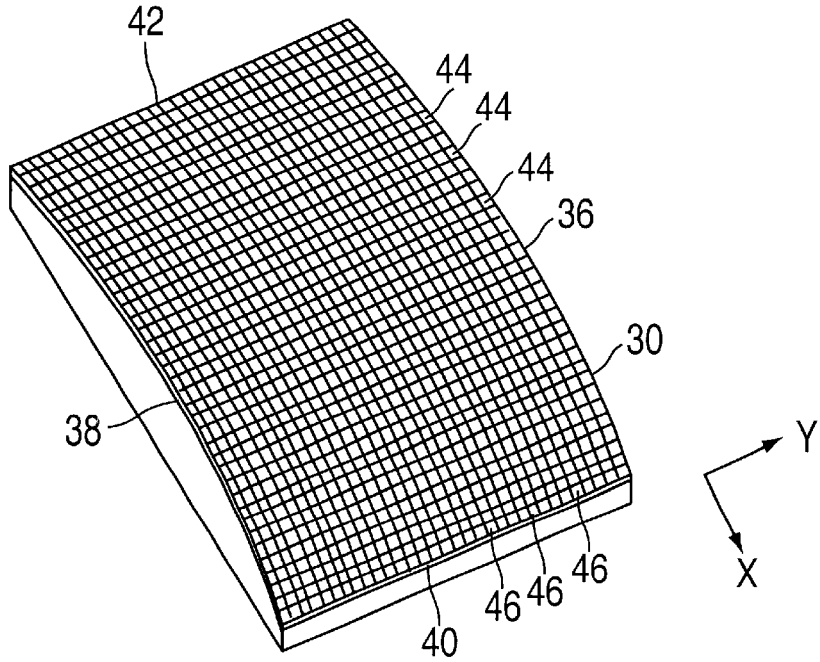
FIG. 2 is a perspective view of a tension focus mask.

The tension focus mask 30, shown in greater detail in FIG. 2, includes two longs sides 36 and 38 and two short sides 40 and 42. The two long sides 36 and 38 of the focus mask parallel a central major axis, x, of the tube. The tension focus mask 30 includes two sets of conductive lines: strands 44 that are parallel to the central minor access y and to each other; and wires 46, that are parallel to the central major access x and to each other. The strands 44 and wires 46 are coupled to busbars (not shown) on their distal ends to provide tension as well as voltage to the wires and strands. In a preferred embodiment, the strands 44 are flat strips that extend vertically, having a width of about 13 mils. and a thickness of about 2 mils., and the wires 46 have a round cross section, having a diameter of approximately 1 mil. and extend horizontally. In the completed focus mask, the strands and wires are separated from each other by suitable insulators such as FOX.

Figures 6, 7:
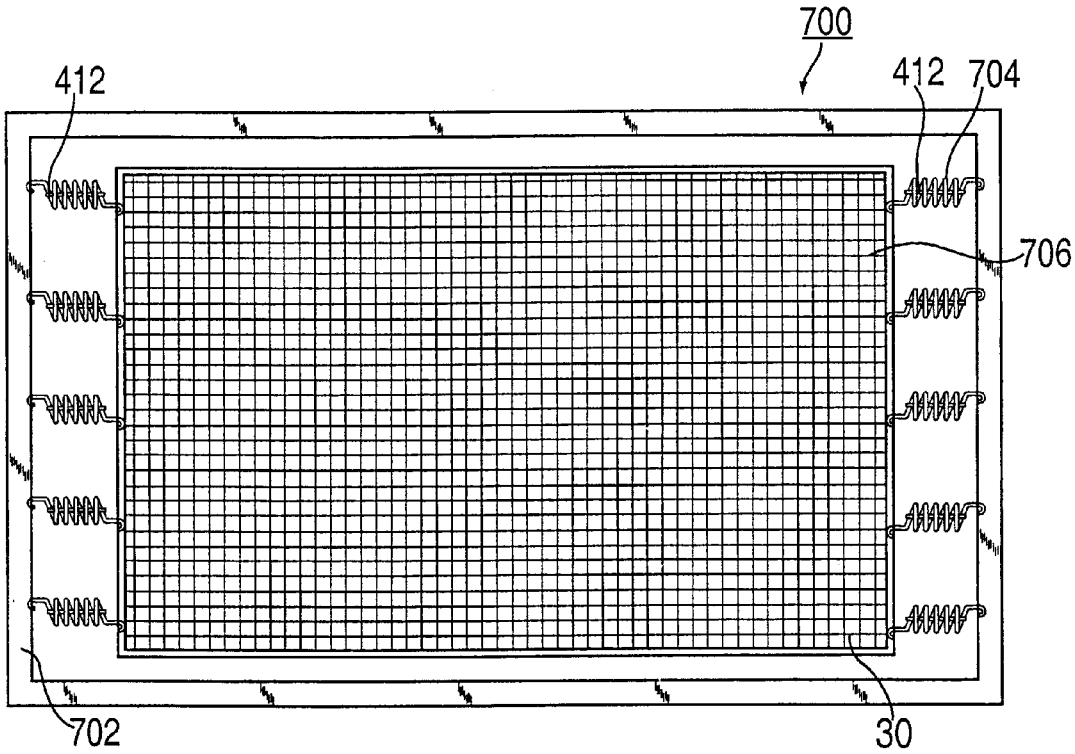
FIG. 6 is a chart displaying tuning fork decay times.
FIG. 7 is a top plan view of a tension focus mask assembly.

FIG. 7 depicts a top plan view of a tension focus mask assembly 700 in accordance with the present invention. The tension focus mask assembly 700 comprises the tension focus mask 30 of FIG. 2 mounted in a rectangular frame 702 via a vibration reducing assembly 704. The vibration reducing assembly 704 resiliently couples the frame 702 to the focus mask 30 to rapidly suppress any vibration of the focus mask. More specifically, the focus mask 30 comprises two busbar assemblies 706 at the end of the major axis. The vibration reducing assembly 704 is connected at the focus mask edge and busbar assemblies and the frame 702.

Figure 3:
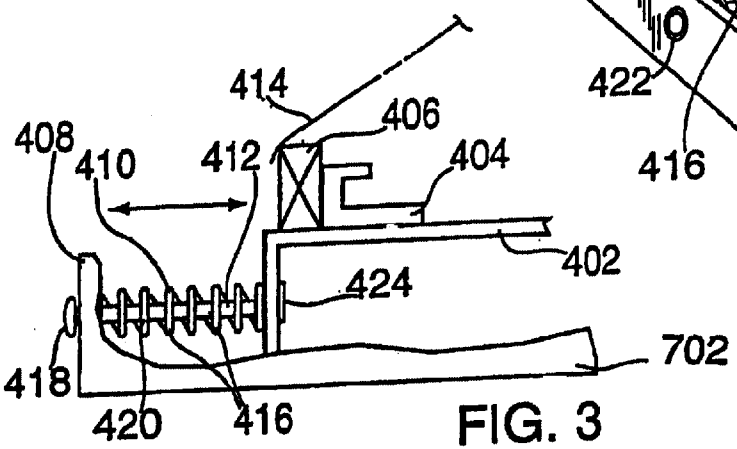
FIG. 3 is a side view, partly in axial section, of a vibration reducing assembly according to the present invention.

FIG. 3 is a side view, partly in axial section, of a portion of the tension focus mask assembly 700 comprising the vThration reducing assembly 704 according to the present invention. The vibration reducing assembly 704 in one embodiment of the invention is a spring scrubber assembly 416 that is mounted between the rectangular frame 702 and the busbar assembly 706. The busbar assembly 706 comprises a busbar 406 and a set of brackets 402 and 404. The busbar 406 is affixed upon a horizontal busbar support bracket 402. The horizontal busbar support bracket 402 is formed in the shape of an "L" that has been rotated clockwise by 90 degrees on center. A vertical busbar support bracket 404 is attached to both the horizontal busbar support bracket 402 and the busbar 406. The vertical busbar support bracket 404 is formed in the shape of an inverted "L" that has been rotated counterclockwise by 90 degrees on center. The vertical busbar support bracket 404 is attached directly next to the busbar 406 and provides support for the busbar 406, preventing the busbar 406 from rolling inward toward the center of the focus mask frame assembly 700. A tensional force is applied to the busbar 406 during the creation of the tension focus mask 30. The strands (not shown) and the wires 46 affixed to the busbar 406 are placed under tensional force pulling out from the center of the tension focus mask 30. For this reason, the vertical busbar support bracket 404 is necessary.

Figure 4:
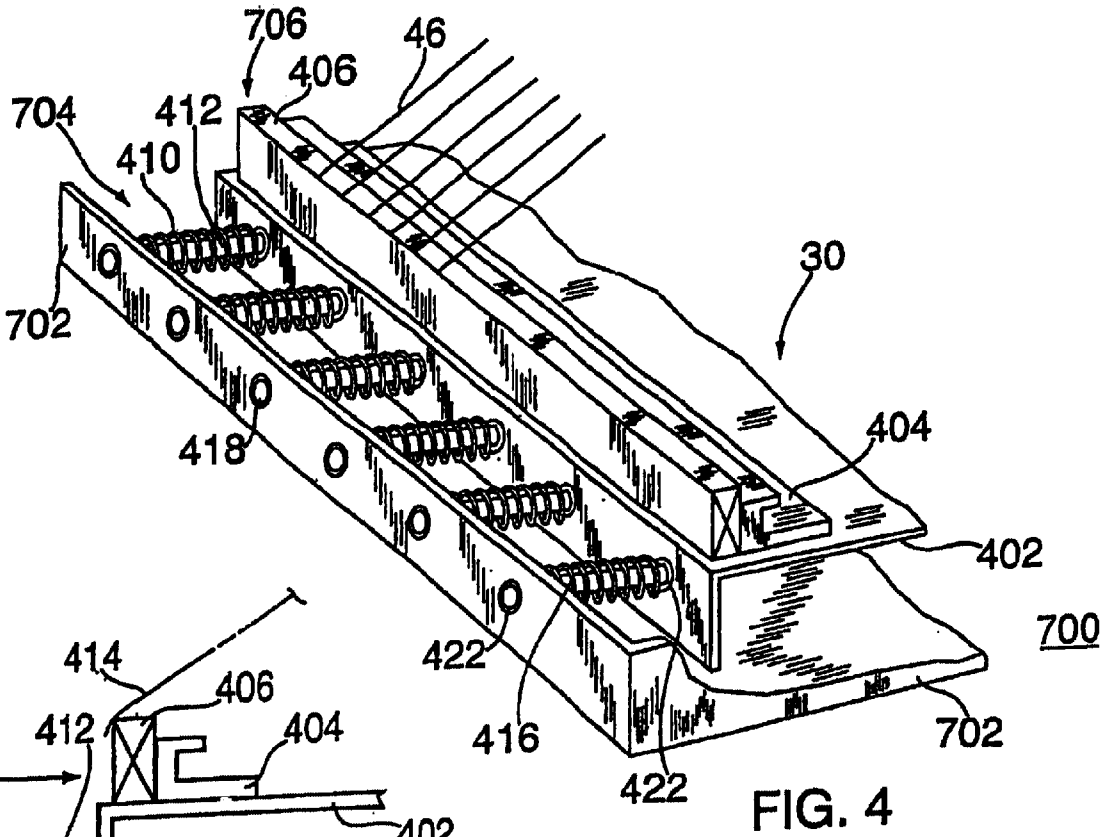
FIG. 4 is a perspective view of the vibration reducing assembly according to the present invention.

The horizontal busbar support bracket 404 is attached to the focus mask 30 by means of the pin scrubber assembly 416. The spring pin scrubber assembly 416 is affixed under tension to the horizontal busbar support 402 and the focus mask assembly 30 as shown in FIGS. 3 and 4. The spring pin scrubber assembly 416 comprises a tension coil spring 410 and a pin 412. The pin 412 is captured in the spring 410 between the frame 702 and the support bracket 402 so that the pin 412 will not fall out of the tension coil spring aperture 420 under normal circumstances. However, the pin 412 can move back and forth and is free to roll within the spring aperture 420. The spring 410 may be formed of steel, stainless steel or any high temperature spring steel. The pin 412 is made of stainless steel or any steel or alloy with the same weight and the like.

The spring 410 is maintained under a varying tension and has a varying spring constant according to the specific requirements of the embodiment. The length of the pin 412 is at least three quarters of the length of the tension springs' coils 410 when the spring 410 is not under tension. The outside diameter of the pin 412 is less than the inside diameter of the springs' internal coil diameter 410. The outside diameter of the pin 412 is such that it creates a sliding fit with the internal walls of the spring 410.

The spring pin scrubber assembly 416 is attached to the focus mask 30 and frame 702 by hooks 418; 424 formed on the ends of the tension coil spring 410. The spring pin scrubber assembly 416 is also attached to the horizontal busbar support 402 but is only attached to prevent the support 402 from dropping through frame 702. One end of the spring pin scrubber 416 is inserted or attached to the focus mask by inserting the hook end 418 of the tension coil spring 410 into a slot or aperture 422 disposed upon the focus mask assembly 402. Depending on whether or not the opposite end of the focus mask (not shown) has been previously attached, the tension coil spring 410 may or may not need to be extended in order to secure the frame 702 to the horizontal busbar support 402. If the opposite end of the focus mask 30 has been secured to the frame 702, the method of affixing the hook end 418 of the tension spring 410 is as follows: The hook 424 must be grasped and a pulling force applied to extend the spring 410 such that the hook 424 may be secured to a securing point 422 on the busbar assembly 706 under tension.

As can be seen in FIG. 4, a perspective view of one embodiment of the invention, a plurality of spring pin scrubbers 416 have been placed between the horizontal busbar support assembly 402 and the focus mask frame 702 so as to create a vibration reducing effect. During actual use, the spring pulls and releases due to vibrational forces and impacts upon the focus mask assembly 700. As the focus mask assembly vibrates, the spring pin 412 rubs against the coils of the coil spring 410, scrubbing away the energy, thus reducing the vibration. The vibrations that do not move the horizontal busbar support assembly 402 into or away from the spring pin scrubber assembly 416 or focus mask assembly 30, but move in other directions, will cause the pin of the spring pin scrubber 416 to roll within the spring 410, also scrubbing energy away.

Figure 5A:
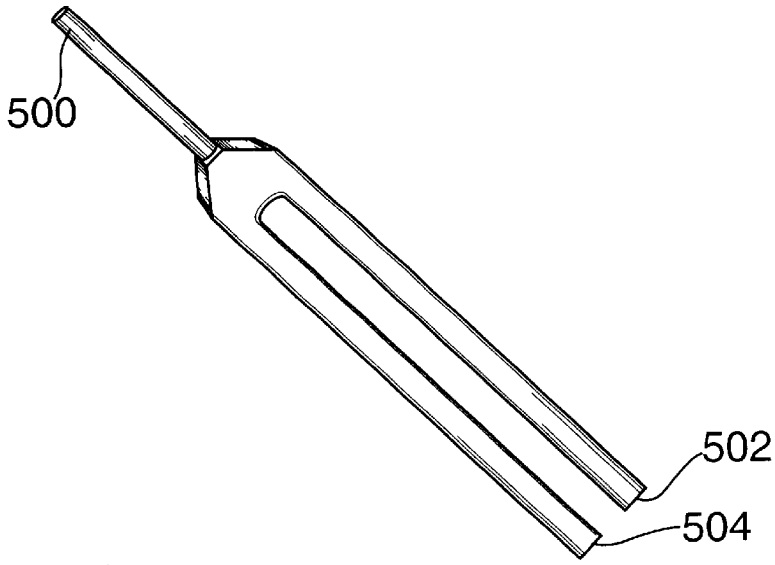
FIGS. 5A, B and C together depict the resonating effects between three tuning forks.

Both the focus mask frame 702 and the horizontal busbar support assembly 706 have natural resonant frequencies, each however, is formed such that their individual resonant frequencies differ greatly. The resonant frequency of an object directly corresponds to the vibrational time duration of any shock or impact to the object. Any object with a plurality of appendages may have multiple resonant frequencies, an example of which is a tuning fork depicted in FIGS. 5A, 5B and 5C. As can be seen in FIG. 5A, a tuning fork 500 having tines 502 and 504 are of the same frequency will vibrate upon impact in harmony and dissipate energy linearly over time. While the speed of dissipation can be enhanced by the use of coil dissipaters 506 of FIG. 5B that are wrapped around each tine 502 and 504, although there still exists a considerable decay time. As depicted in FIB. 5C, the best method to shorten the decay time is to form each tine element 510 and 512 such that their resonant frequencies differ greatly. As in the tuning fork example, by forming one tine 510 at a resonant frequency of 200 Hz and one tine 512 at a resonant frequency of 100 Hz, the resonance decay can be reduced significantly over a tuning fork with equal resonant frequencies of each tine or the use of spring dissipaters on each tine.

Figure 5B:
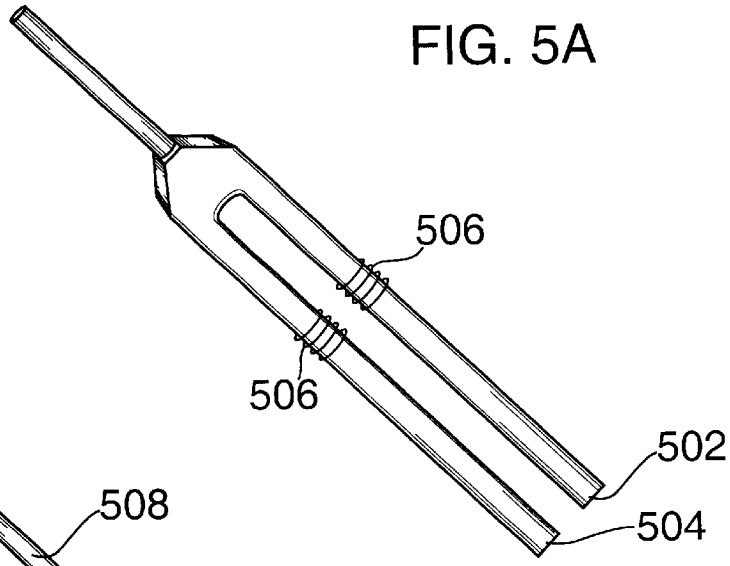
Figure 5C:
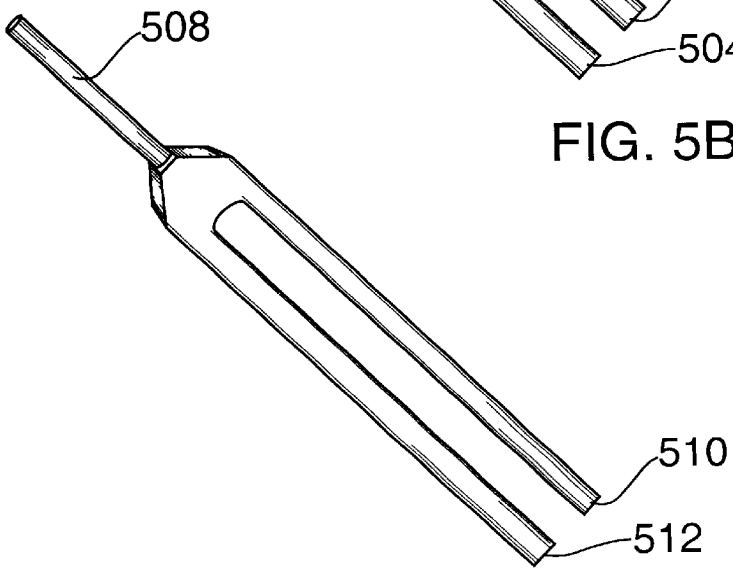

FIG. 6 is a table that shows the decay times of various tuning forks of FIGS. 5A–5C. Of interest is the rate of decay of the de-tuned fork, clearly the rate is far more desirable than that of the other two described fork designs for the purpose of reducing vibration. The de-tuning method is also more cost effective in that this method reduces material required to reduce vibration and reduces labor of installing additional vibration reducing devices.

Referring back to FIG. 4, the horizontal busbar support bracket 402 is formed of a different thickness than the focus mask frame 702. FIG. 4 shows the busbar support bracket 402 that attaches to the frame 702 in such a way that its natural resonate frequency is far lower than the tensioned focus mask frequency. The vibration frequency 702 is independent of the busbar 402 and vibration 30 frequency. The focus mask vibration frequency is easily changed by the amount of stress applied to the focus mask. The busbar's vibration frequency can be raised or lowered by its method of attachment to the frame, the stiffer the attachment, the higher the frequency, and the softer the attachment, the lower the frequency. This difference is resonant frequencies will provide an effect similar to that of the decay time shown in FIG. 6.

Although the vibration reducing effect of detuning the frame 702 and busbar assembly 706 can function well using any form of assembly that couples the frame 702 to the focus mask 30, the combination of the detuned frame/mask and the vibration reducing assembly 704 provides excellent vibration dampening for a tension focus mask assembly 700.

As the embodiments that incorporate the teachings of the present invention have been shown and described in detail, those skilled in the art can readily devise many other varied embodiments that still incorporate these teachings without departing from the spirit of the invention.

What is claimed is:

1. An apparatus for reducing vibrational energy in a focus mask having a plurality of crosswires, comprising:

(a) a busbar assembly for affixing corresponding ends of said plurality of crosswires thereto;

(b) a mask frame; and (c) a vibration reducing assembly affixed at a first end to the busbar assembly and a second end affixed to the mask frame such that said focus mask is coupled to said frame via said vibration reducing assembly.

2. The apparatus of claim 1 wherein the busbar assembly further comprises a busbar, a busbar support and a busbar mounting bracket.

3. The apparatus of claim 2 wherein at least one portion of the mask frame is parallel to the busbar support.

4. The apparatus of claim 1 wherein said vibration reducing assembly includes a spring pin scrubber assembly.

5. The apparatus of claim 4 wherein the spring pin scrubber assembly is positioned horizontally between the frame assembly and the busbar support.

6. The apparatus of claim 1 wherein the busbar assembly resonates at a different frequency than the mask assembly.

7. The apparatus of claim 4 wherein the spring pin scrubber assembly comprises a pin inserted into the center aperture of the spring.

8. A cathode ray tube (CRT) having a funnel sealed at one end to a faceplate panel with a luminescent screen on an interior surface thereof, a mask frame assembly supported within the CRT proximate to the screen having a mask and a mask frame, the mask frame assembly comprising:

a busbar for fixing ends of the mask; and a vibration reducing assembly having a first end attached to the busbar and a second end attached to the mask frame such that the busbar is coupled to the mask frame by the vibration reducing assembly.

9. The CRT of claim 8, further comprising a first bracket for supporting the busbar, and a second bracket attached to the vibration reducing assembly.

10. The CRT of claim 8, wherein the busbar resonates at a different frequency than the mask.

11. The CRT of claim 8, wherein the frame has a vibration frequency independent from the vibration frequency of the busbar and the mask.

12. The CRT of claim 8, wherein two opposing ends of the mask are fixed to the busbar.

13. The CRT of claim 8, wherein the vibration reducing assembly includes a tension coil spring.

14. The CRT of claim 13, wherein the tension coil spring is positioned horizontally between the frame and the busbar.

15. The CRT of claim 13, further comprising a pin that the tension coil spring encompasses.

16. The CRT of claim 15, wherein the pin contacts coils of the tension coil spring and is capable of sliding and rotating in relation to the coils.

17. A method of reducing vibrational energy in a mask mounted in a cathode ray tube (CRT) comprising:

attaching ends of the mask to a busbar assembly;

coupling the mask to a mask frame by a vibration reducing assembly;

tensioning a spring between the mask and the mask frame; and positioning a pin inside a coil of the spring.

* * * * *